US005937764A

United States Patent [19]

Olivier

[11] Patent Number: 5,937,764

[45] Date of Patent: Aug. 17, 1999

[54] MOTORIZED DINING TABLE

[76] Inventor: Cecil V. Olivier, 1661 George Ave., #4, Windsor, Canada, N8Y 2Y5

[21] Appl. No.: 09/149,351

[22] Filed: Sep. 8, 1998

[51] Int. Cl.[6] ..... A47B 5/00

[52] U.S. Cl. ..... 108/20

[58] Field of Search ..... 108/20, 21, 22, 108/150, 98, 95, 103, 25, 26, 27

[56] References Cited

U.S. PATENT DOCUMENTS

| | | | |
|---|---|---|---|
| 1,095,239 | 5/1914 | Strandberg | 108/20 |
| 1,118,851 | 11/1914 | Turner | 108/20 X |
| 1,257,871 | 2/1918 | Jaquette | 108/20 |
| 1,676,108 | 7/1928 | Novak | 108/20 |
| 2,759,611 | 8/1956 | Davis | 108/20 |
| 2,890,010 | 6/1959 | Barkheimer | 108/20 X |
| 3,993,375 | 11/1976 | Potter . | |
| 4,060,038 | 11/1977 | Ruvolo . | |
| 4,656,951 | 4/1987 | Kimura et al. | 108/20 |
| 4,815,392 | 3/1989 | Sööt . | |
| 5,109,989 | 5/1992 | Kremmin et al. | 108/20 X |
| 5,421,271 | 6/1995 | Sui | 108/20 |
| 5,479,867 | 1/1996 | Blevins et al. . | |

*Primary Examiner*—Jose V. Chen
*Attorney, Agent, or Firm*—Henderson & Sturm

[57] ABSTRACT

A motorized dining table construction 10 including a table member 20 having a table top 21 provided with central recess 22 dimensioned to receive a rotatable insert unit 12 which is provided by a drive unit 13 operatively associated with a variable speed control unit 14 which comprises a foot pedal operated rheostat based control member 50.

5 Claims, 1 Drawing Sheet

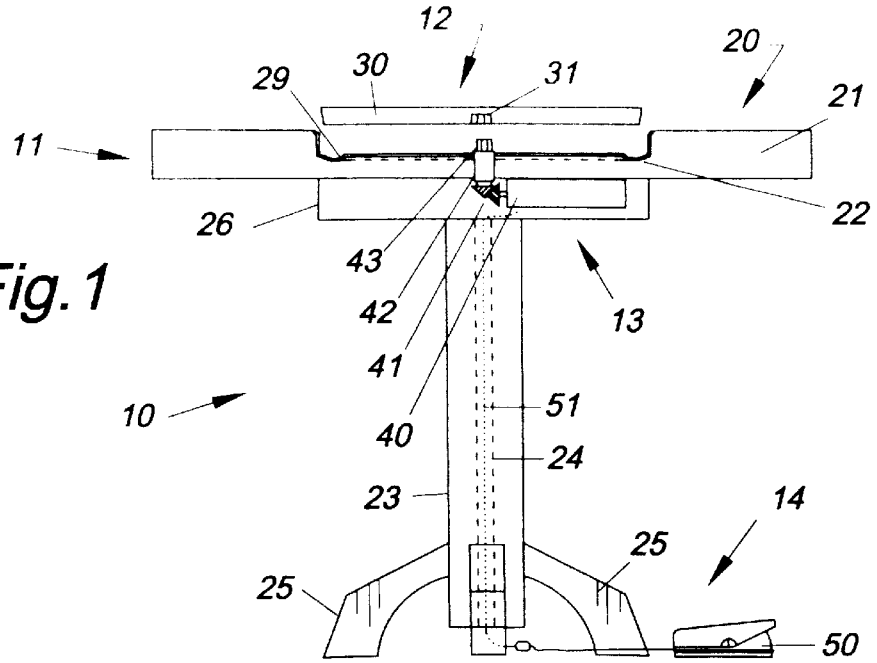
Fig. 1
Fig.2
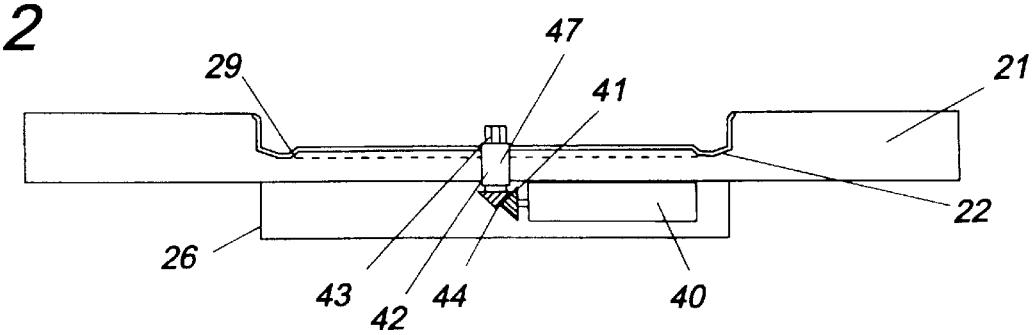
Fig.3
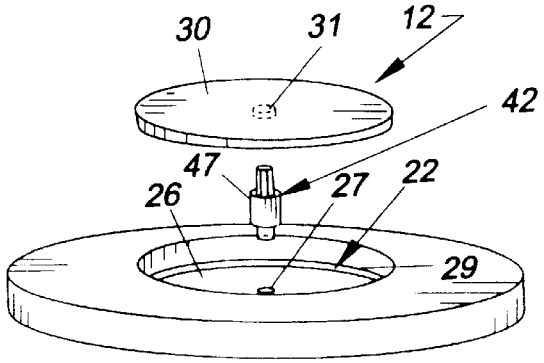

MOTORIZED DINING TABLE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of rotary turntables in general, and in particular to a variable speed control motorized dining table.

2. Description of Related Art

As can be seen by reference to the following U.S. Pat. Nos. 3,993,375; 4,060,038; 4,815,392; and 5,479,867, the prior art is replete with myriad and diverse rotary table constructions.

While all of the aforementioned prior art constructions are more than adequate for the basic purpose and function for which they have been specifically designed, they are uniformly deficient with respect to their failure to provide a simple, efficient, and practical motorized dining table having a variable speed control feature for the rotary central portion of the table top surface.

As most families are aware, most group meals are constantly being interrupted by the need for one or more of the individuals at a table passing around different dishes and/or condiments to other individuals situated at different locations around the table. Not only is this situation time consuming and bothersome, but it also interrupts and generally spoils the communal/familial spirit that would normally be generated without the presence of constant interruptions.

As a consequence of the foregoing situation, there has existed a longstanding need for a new and improved motorized dining table having a variable speed central rotating portion wherein the variable speed control is operated in a hands free manner by an adult, and the provision of such a construction is a stated objective of the present invention.

BRIEF SUMMARY OF THE INVENTION

Briefly stated, the motorized dining table construction that forms the basis of the present invention comprises in general, a main table unit, a rotary insert unit, a drive unit, and a variable speed control unit.

As will be explained in greater detail further on in the specification, the table unit comprises a pedestal style table member wherein the table top is provided with a central recess dimensioned to receive the rotary insert unit which includes a rotary insert member.

In addition, the rotary insert member is operatively connected to the drive unit which imparts rotary motion to the insert member in response to a variable speed control unit.

Furthermore, the variable speed control unit comprises a conventional foot pedal operated rheostat based control member wherein the speed of the insert member can be controlled in a hands free fashion.

BRIEF DESCRIPTION OF THE SEVERAL VIEWS OF THE DRAWINGS

These and other attributes of the invention will become more clear upon a thorough study of the following description of the best mode for carrying out the invention, particulary when reviewed in conjunction with the drawings, wherein:

FIG. 1 is a partially exploded cross sectional view of the motorized dining table construction that forms the basis of the present invention;

FIG. 2 is an enlarged detail view of the drive unit; and

FIG. 3 is an exploded perspective view of the table top and the insert unit.

DETAILED DESCRIPTION OF THE INVENTION

As can be seen by reference to the drawings, and in particularly to FIG. 1, the motorized table construction that forms the basis of the present invention is designated generally by the reference number 10. The construction 10 comprises in general, a main table 11, a rotary insert unit 12, a drive unit 13, and a variable speed control unit 14. These units will now be described in seriatim fashion.

As shown in FIGS. 1 and 3, the main table unit 11 comprises a pedestal style main table member 20 having a circular table top 21 provided with an enlarged central recess 22 and disposed on the upper end of a hollow central pedestal 23 having a vertical central bore 24 formed therein. The lower end of the pedestal element 23 is provided with a plurality of outwardly extending support legs 25.

In addition, as can also be seen by reference to FIGS. 1 and 3, the bottom portion of the table top 21 is further provided with a hollow lower housing element 26 which is disposed intermediate the table top 21 and the pedestal element 23 wherein the central bore 24 of the pedestal element 23 extends through the bottom of the lower housing element 26. The top of the lower housing element 26 is provided with a discrete aperture 27 whose purpose and function will be explained in greater detail further on in the specification.

Still referring to FIGS. 1 and 3, it can be seen that the rotary insert unit 12 comprises a circular insert member 30 dimensioned to be rotatably received in the central recess 22 of the circular table top 21 wherein the top surface of the insert member 30 is flat and the bottom surface of the insert member 30 is provided with a knurled recess 31 whose purpose and function will be described presently.

As can best be seen by reference to FIGS. 1 and 2, the drive unit 13 comprises a rotary drive motor 40 disposed within the hollow housing element 26 and provided with a conically shaped gear drive element 41 beneath and proximate to the discrete aperture 27 in the top of the lower housing element 26.

The drive unit 13 further comprises a drive shaft 42 rotatably suspended by a bearing collar 47 which is dimensioned to be fixedly received in the discrete aperture 27 in the top of the lower housing element 26. The upper end of the drive shaft 42 is provided with a knurled head 43 dimensioned to be frictionally received in the knurled recess 31 in the bottom of the insert member 30 and the lower end of the drive shaft 42 is provided with a conically shaped gear face 44 that is dimensioned to engage the conically shaped gear drive element 41 to impart rotary motion to the insert member 30 in a well recognized fashion.

Returning once more to FIG. 1, it can be seen that the variable speed control unit 14 comprises a conventional foot pedal operated rheostat based control member 50 which is connected to the drive motor 40 via an electrical wire 51 which is threaded through the central bore 24 in the pedestal element 23 and operatively connected to the drive motor 40.

Turning now to FIGS. 2 and 3, it can be seen that this invention also contemplates the provision of a peripheral groove 29 around the enlarged central recess 22 in the table top 21 to prevent spilled articles, objects or foodstuffs from joining the rotary movement of the rotary insert member 30.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A motorized dining table construction comprising:

a table member including: a table top provided with an enlarged circular central recess having a discrete aperture formed therein and a peripheral groove provided on the outer periphery of the central recess; an elongated hollow pedestal element having an upper portion operatively associated with the table top, a lower portion provided with a plurality of support legs and a vertical bore extending from the upper portion to the lower portion; and a hollow housing element disposed intermediate the bottom of the table top and the upper portion of the pedestal element wherein the hollow housing element is further disposed beneath said central recess;

a rotary insert unit including a generally circular insert member dimensioned to be received in said central recess and having a flat surface and a bottom surface provided with a knurled recess;

a drive unit including a drive shaft rotatably suspended in a bearing collar which is fixedly secured in said discrete central aperture; wherein the drive shaft has an upper portion and a lower portion wherein the upper portion of the drive shaft is dimensioned to be frictionally engaged in the knurled central recess in the insert member; and means engageable with the lower portion of the drive shaft for imparting a variable speed rotary motion thereto.

2. The construction as in claim 1 further comprising:

a drive unit including a drive motor disposed within the hollow housing element and provided with a gear drive element engageable with the lower portion of the drive shaft.

3. The construction as in claim 2 wherein the lower portion of the drive shaft is provided with a conically shaped gear face and the gear drive element is provided with a complementary conically shaped face.

4. The construction as in claim 3 further comprising:

a variable speed control unit operatively associated with said drive motor and including a foot pedal operated rheostat based control member.

5. The construction as in claim 4 wherein said table top has a generally circular configuration.

* * * * *